US012173608B2

(12) United States Patent
Sekiyama et al.

(10) Patent No.: US 12,173,608 B2
(45) Date of Patent: Dec. 24, 2024

(54) TUNNEL EXCAVATION DEVICE

(71) Applicant: KOMATSU LTD., Tokyo (JP)

(72) Inventors: Naoki Sekiyama, Tokyo (JP); Hiroshi Asano, Tokyo (JP)

(73) Assignee: KOMATSU LTD., Tokyo (JP)

( * ) Notice: Subject to any disclaimer, the term of this patent is extended or adjusted under 35 U.S.C. 154(b) by 172 days.

(21) Appl. No.: 17/924,015

(22) PCT Filed: Apr. 20, 2021

(86) PCT No.: PCT/JP2021/016038
§ 371 (c)(1),
(2) Date: Nov. 8, 2022

(87) PCT Pub. No.: WO2021/241080
PCT Pub. Date: Dec. 2, 2021

(65) Prior Publication Data

US 2023/0212948 A1 Jul. 6, 2023

(30) Foreign Application Priority Data

May 25, 2020 (JP) ..... 2020-090878

(51) Int. Cl.
*E21D 9/10* (2006.01)
*E21D 9/11* (2006.01)

(52) U.S. Cl.
CPC ..... *E21D 9/112* (2013.01)

(58) Field of Classification Search
CPC ..... E21D 9/112; E21D 9/10
See application file for complete search history.

(56) References Cited

U.S. PATENT DOCUMENTS 4,486,050 A 12/1984 Snyder
4,494,799 A 1/1985 Snyder
5,931,601 A * 8/1999 Terada ..... E21B 7/28 405/138

(Continued)

FOREIGN PATENT DOCUMENTS

JP 2000-130075 A 5/2000
JP 2001-20678 A 1/2001

(Continued)

OTHER PUBLICATIONS

The International Search Report for the corresponding international application No. PCT/JP2021/016038, issued on May 25, 2021.

(Continued)

*Primary Examiner* — Carib A Oquendo
(74) *Attorney, Agent, or Firm* — Global IP Counselors, LLP

(57) ABSTRACT

A tunnel excavation device includes a first body portion and an erector device. The first body portion includes a cutter head and a support portion rotatably supporting the cutter head. The erector device is configured to transport a supporting member toward an excavated wall surface. The erector device is provided on the support portion. The erector device includes a ring portion holding the supporting member, and a posture changing device configured to change an angle formed by a center axis of the ring portion and a rotation axis of the cutter head in a plan view.

9 Claims, 7 Drawing Sheets

(56) References Cited

U.S. PATENT DOCUMENTS

| | | | | |
|---|---|---|---|---|
| 2002/0031403 | A1* | 3/2002 | Konda | E21D 9/093<br>405/138 |
| 2016/0230553 | A1* | 8/2016 | Kuramoto | E21D 9/108 |

FOREIGN PATENT DOCUMENTS

| | | | |
|---|---|---|---|
| JP | 2001-65282 | A | 3/2001 |
| JP | 2004-132105 | A | 4/2004 |
| JP | 2012-202033 | A | 10/2012 |

OTHER PUBLICATIONS

The Office Action for the corresponding Japanese application No. 2020-090878 issued on Jun. 18, 2024.

* cited by examiner

TUNNEL EXCAVATION DEVICE

CROSS-REFERENCE TO RELATED APPLICATIONS

This application is a U.S. National stage application of International Application No. PCT/JP2021/016038, filed on Apr. 20, 2021. This U.S. National stage application claims priority under 35 U.S.C. § 119(a) to Japanese Patent Application No. 2020-090878, filed in Japan on May 25, 2020, the entire contents of which are hereby incorporated herein by reference.

BACKGROUND

Technical Field

The present disclosure relates to a tunnel excavation device.

Background Information

Conventionally, a tunnel excavation device is used to excavate a bedrock in civil engineering work. The tunnel excavation device has a body including a cutter head and an erector device provided at a rear of the body. The erector device includes a ring portion and a support portion which supports a supporting member. The erector device disposes the supporting member at a predetermined position on a wall surface of an excavation passage formed by the excavation. A plurality of supporting members are used as tunnel shoring by assembling the plurality of supporting members in a ring shape or an arch shape. The tunnel shoring supports the wall surface of the excavation passage after excavation. The tunnel shoring is preferably installed at a position where a circle, which is defined by a center axis line of the excavation passage, contacts the excavated wall surface. A center of the ring portion is disposed on the rotation axis of the cutter head. The support portion is provided on the ring portion. The support portion is configured to be radially extendable with respect to the ring portion.

SUMMARY

In the conventional tunnel excavation device, the support portion extends and contracts in the radial direction with respect to the ring portion in a state where the center of the ring portion is disposed on the rotation axis of the cutter head. With this configuration, when the tunnel excavation device forms the excavation passage which curves with a small curvature radius, it is difficult to dispose the supporting member at a position where the circle, which is defined by a center axis line of the excavation passage, contacts the excavated wall surface.

An object of the present disclosure is to provide a tunnel excavation device which can suitably dispose a supporting member on an excavation passage in case that a curved excavation passage is formed.

Solution to Problems

A tunnel excavation device according to the present disclosure includes a first body portion and an erector device. The first body portion includes a cutter head and a support portion rotatably supporting the cutter head. The erector device is configured to transport a supporting member toward an excavated wall surface. The erector device is provided on the support portion. The erector device includes a ring portion holding the supporting member and a posture changing device. The posture changing device is configured to change an angle formed by a center axis of the ring portion and a rotation axis of the cutter head in a plan view.

With the present disclosure, a tunnel excavation device can suitably dispose a supporting member on a tunnel in case that a curved tunnel is formed.

DETAILED DESCRIPTION OF EMBODIMENT(S)

A tunnel excavation device 1 according to the present disclosure will be described with reference to the drawings. The tunnel excavation device 1 of this embodiment is called a TBM (Tunnel Boring Machine). For example, TBM includes a gripper TBM and a hard-rock TBM. The tunnel excavation device 1 of this embodiment can be used for a hard-rock excavation.

(An Overall Configuration of a Tunnel Excavation Device)

Figure 1:
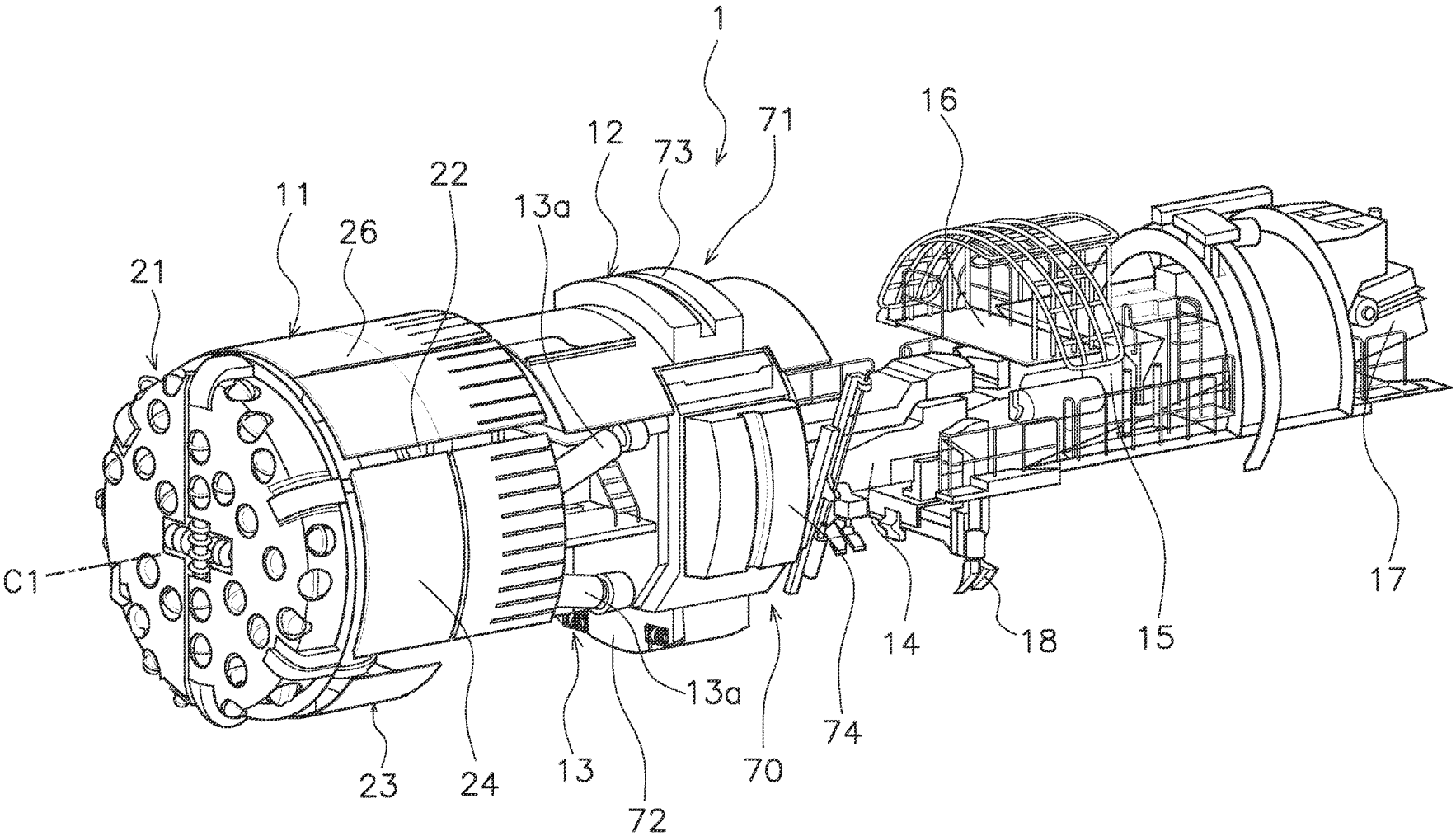
FIG. 1 is a perspective view showing configuration of a tunnel excavation device according to an embodiment of the present disclosure.
Figure 2:
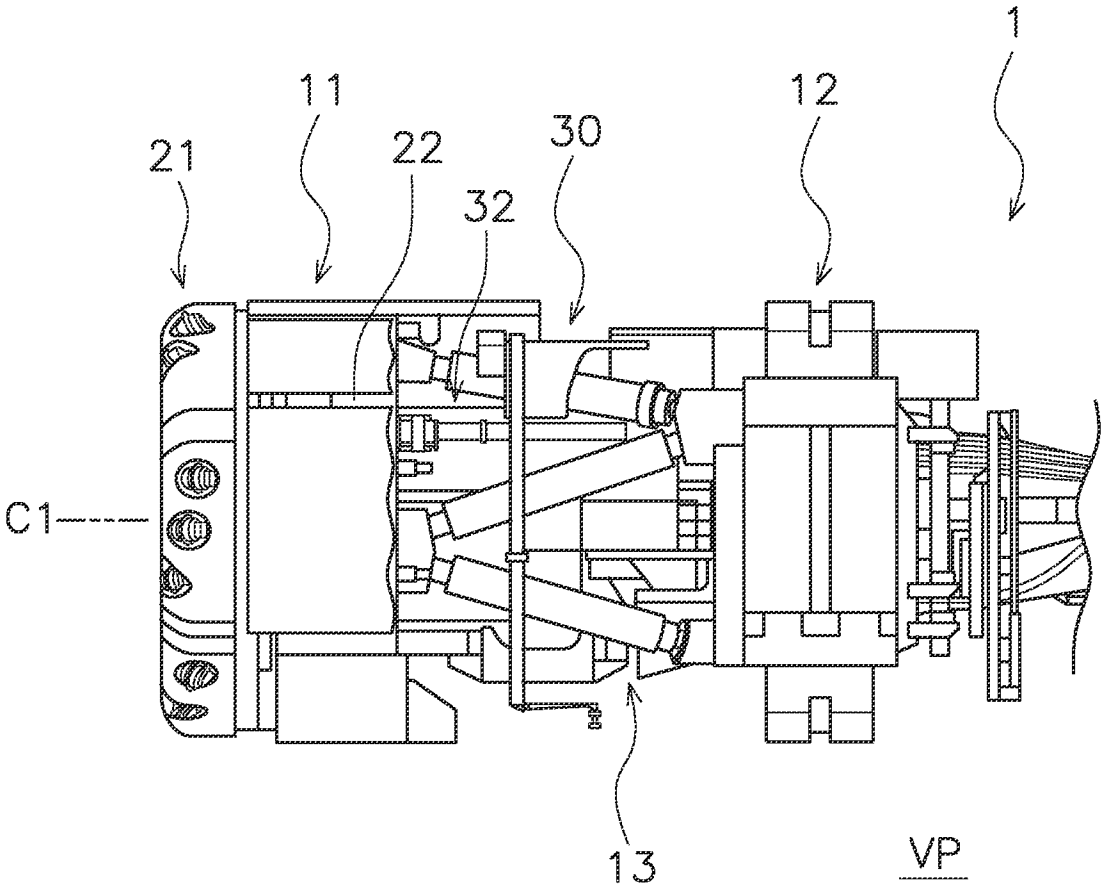
FIG. 2 is a side view showing front and rear body portions of the tunnel excavation device of FIG. 1.

FIG. 1 is a perspective view showing a tunnel excavation device 1 of this embodiment. FIG. 2 is a side view of the tunnel excavation device 1 of this embodiment. The paper surface of FIG. 2 shows a vertical plane VP. As shown in FIG. 1, the tunnel excavation device 1 includes a front body portion 11 (an example of a first body portion), a rear body portion 12 (an example of a second body portion) and an erector device 30 (see FIG. 2). The tunnel excavation device 1 further includes a connecting portion 13, a main beam 14, a pedestal 15, a workbench 16, a belt conveyor 17 and a rear support 18.

The front body portion 11 includes a cutter head 21 at a front end of the front body portion 11. The cutter head 21 excavates a bedrock. The rear body portion 12 is disposed behind the front body portion 11. The rear body portion 12 includes a gripper 71. The gripper 71 presses against an inner wall of the tunnel to obtain reaction force during excavation. The cutter head 21 includes a rotation axis C1.

The erector device 30 is used to dispose a supporting member S on an excavated wall surface. The erector device 30 is provided on the front body portion 11. For example, the erector device 30 is provided swingably on the front body portion 11.

The connecting portion 13 connects the front body portion 11 and the rear body portion 12. Specifically, the connecting portion 13 connects so that the front body portion 11 can be bent with respect to the rear body portion 12. The connecting portion 13 includes a plurality of hydraulically actuated thrust cylinders 13*a*. One end of each of the thrust cylinders 13*a* is connected to the front body portion 11 via a spherical bearing. The other end of each of the thrust cylinders 13*a* is connected to the rear body portion 12 via a spherical bearing.

The main beam 14 extends rearward from the rear body portion 12. The pedestal 15 is swingably mounted to the rear end of the main beam 14. The workbench 16 is provided for setting a net on the inner wall of the tunnel after the excavation. The workbench 16 is disposed above the pedestal 15.

The belt conveyor 17 extends from the front body portion 11 to a lower side of the pedestal 15 through the rear body portion 12. The belt conveyor 17 conveys rocks, soil, and the like, which is excavated by the cutter head 21, backward.

The rear support 18 is provided on the main beam 14. The rear support 18 supports the main beam 14 when the rear body portion 12 moves forward.

A vehicle connecting the tunnel excavation device 1 includes a vehicle (not shown) including a control device, a power supply device, a hydraulic system, and the like. The control device, the power supply device, the hydraulic system, and the like are used to operate the cutter head 21, the belt conveyor 17, the plurality of thrust cylinders 13*a*, the gripper 71, the erector device 30, and the like.

(Front Body Portion)

As shown in FIG. 1, the front body portion 11 supports the cutter head 21. For example, the front body portion 11 includes the cutter head 21, a cutter-head support 22 (an example of a support portion), a vertical support 23, a pair of side supports 24 and a roof support 26.

The cutter head 21 configures a front portion of the front body portion 11. Specifically, the cutter head 21 is rotatably provided with respect to the cutter-head support 22.

The cutter-head support 22 is disposed behind the cutter head 21. The cutter-head support 22 rotatably supports the cutter head 21. Front ends of the plurality of thrust cylinders 13*a* are connected to the cutter-head support 22.

The vertical support 23, the pair of side supports 24, and the roof support 26 support the cutter-head support 22 with respect to the inner wall of the tunnel and slide on the inner wall of the tunnel during the excavation. The vertical support 23, the pair of side supports 24, and the roof support 26 are mounted to the cutter-head support 22 so as to surround the cutter-head support 22.

The vertical support 23, the pair of side supports 24, and the roof support 26 are respectively disposed below the cutter-head support 22, on both sides of the cutter-head support 22 in a width direction, and above the cutter-head support 22. The vertical support 23, the pair of side supports 24, and the roof support 26 move in a radial direction away from the cutter-head support 22 and in the radial direction toward the cutter-head support 22 by a link mechanism and hydraulic cylinders (not shown).

(Rear Body Portion)

As shown in FIG. 1, the rear body portion 12 is disposed behind the cutter-head support 22. The rear body portion 12 includes a gripper carrier 70 and the gripper 71. The gripper carrier 70 is disposed behind the cutter-head support 22. For example, the gripper carrier 70 is disposed between the connecting portion 13 and the rear support 18. The gripper carrier 70 is connected to the rear ends of the plurality of thrust cylinders 13*a* of the connecting portion 13. The gripper carrier 70 is supported on the main beam 14. The gripper 71 is provided on the gripper carrier 70.

The gripper 71 is provided on the gripper carrier 70 in order to obtain the reaction force during the excavation. For example, the gripper 71 presses against the inner wall of the tunnel during the excavation and supports the rear body portion 12 with respect to the inner wall of the tunnel. The gripper 71 is disposed on the gripper carrier 70 in a state where the gripper 71 protrudes outwardly from the gripper carrier 70.

The gripper 71 includes a bottom gripper 72 and an upper gripper 73. The gripper 71 further includes a pair of side grippers 74. The bottom gripper 72 is disposed below the gripper carrier 70. The upper gripper 73 is disposed above the gripper carrier 70.

The pair of side grippers 74 are disposed on both sides of the gripper carrier 70 in the width direction. In FIG. 1, only one of the pair of side grippers 74 is shown. The bottom gripper 72, the upper gripper 73, and the pair of side grippers 74 are respectively supported by the gripper carrier 70 via hydraulic cylinders (not shown).

(Erector Device)

Figure 3:
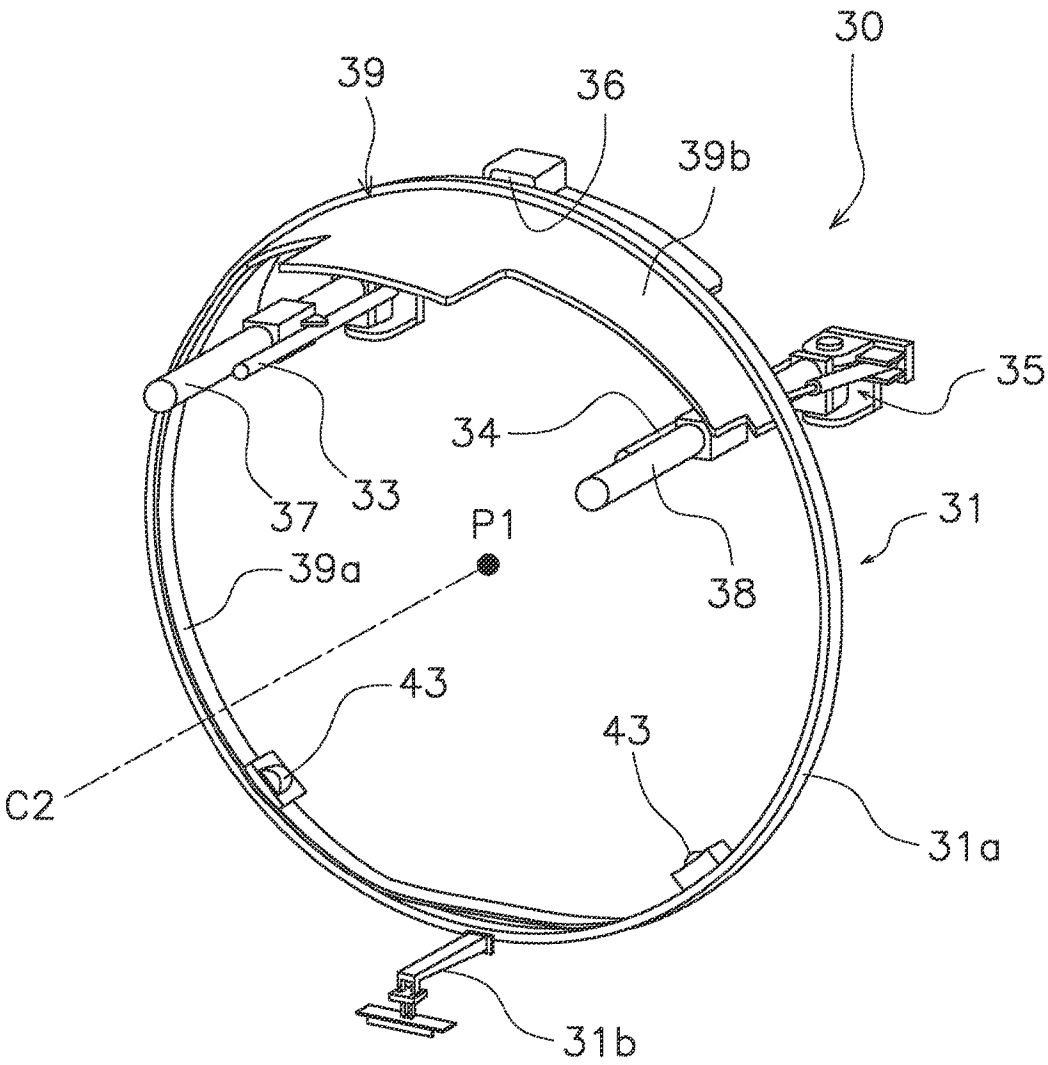
FIG. 3 is a perspective view of an erector device.

The erector device 30 is used to transport the supporting member S toward the excavated wall surface. As shown in FIG. 2, the erector device 30 is provided on the front body portion 11. The erector device 30 is provided on the cutter-head support 22 of the front body portion 11. For example, the erector device 30 is mounted to a rear portion of the cutter-head support 22. The erector device 30 is disposed between the cutter-head support 22 and the rear body portion 12. In this embodiment, the erector device 30 is provided on the front body portion 11. The erector device 30 may be provided on a portion which is different from the front body portion 11. For example, the erector device 30 may be provided on the rear body portion 12. As shown in FIG. 3, the erector device 30 includes a turning ring 31 (an example of a ring portion) and an posture changing device 32. The posture changing device 32 includes thrust cylinders 33 and 34 (an example of a first cylinder), a yawing cylinder 35 (an example of a second cylinder), and a turning motor 36.

Turning Ring

Figure 4:
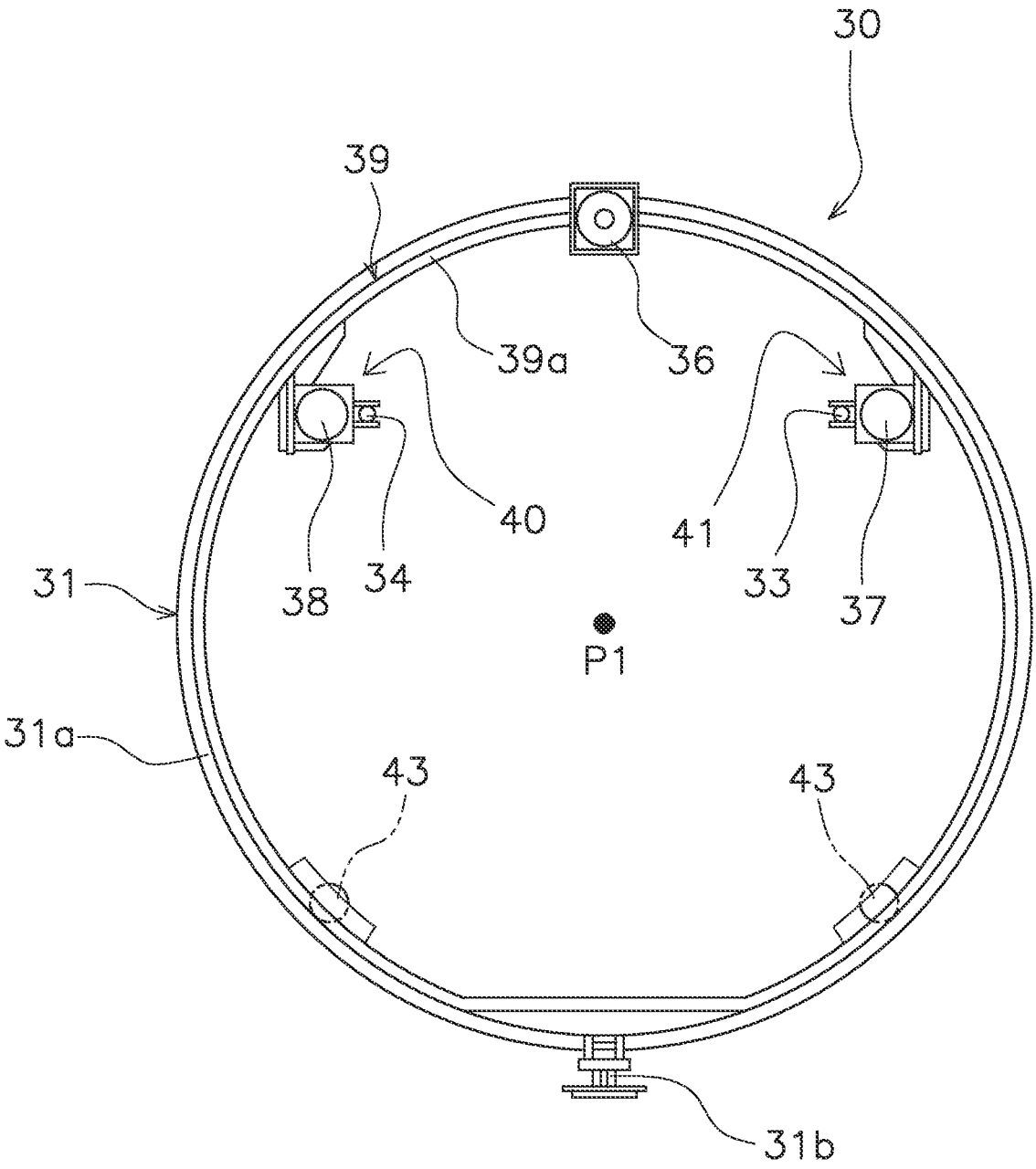
FIG. 4 is a front view of the erector device.

The turning ring 31 holds the supporting member S. As shown in FIGS. 3 and 4, the turning ring 31 is formed in an annular shape. The turning ring 31 includes a turning axis C2 (an example of a central axis of the ring portion). The turning axis C2 passes through a center P1 of the turning ring 31.

The turning ring 31 is supported by the cutter-head support 22 via a posture changing device 32. The turning ring 31 is moved in a direction which the turning ring 31 moves away from the cutter-head support 22 and a direction in which the turning ring 31 moves closer to the cutter-head support 22 by thrust cylinders 33 and 34 (described later) of the posture changing device 32. The turning ring 31 is rotated by a turning motor 36 (described later) of the posture changing device 32. For example, the turning ring 31 is rotated with respect to a support frame 39 by the turning motor 36.

The turning ring 31 includes a first annular portion 31*a* and a support holding portion 31*b*. The first annular portion 31*a* is formed in an annular shape. The turning axis C2 is defined by the first annular portion 31*a*. The support holding portion 31*b* is a portion that holds the supporting member S. The support holding portion 31*b* is provided on the first annular portion 31*a*. The support holding portion 31*b* is formed integrally with the first annular portion 31*a*. One end of the support holding portion 31*b* is fixed to the first annular portion 31*a*. The other end of the support holding portion 31*b* hold the supporting member S.

Posture Change Device

Figure 5A:
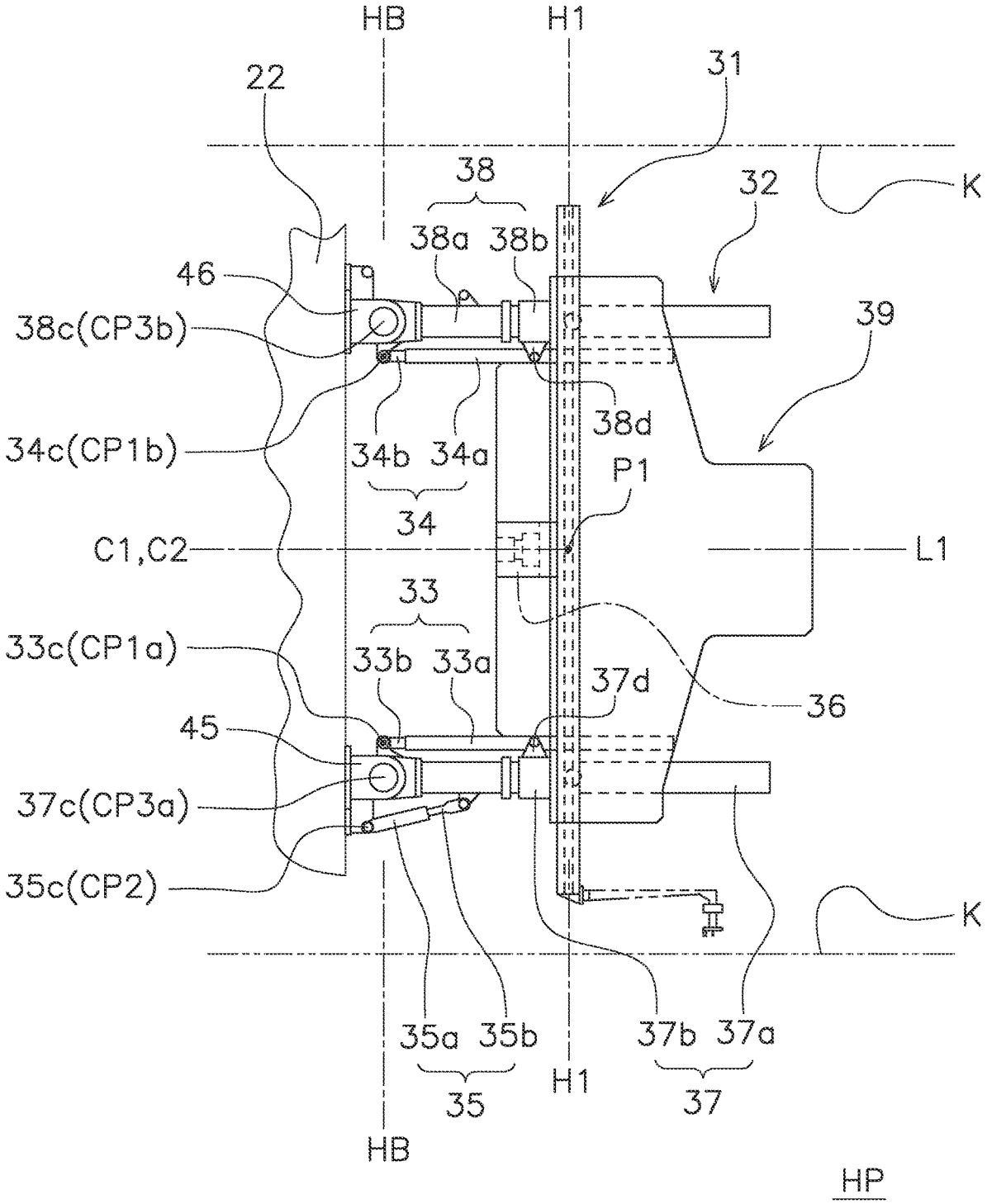
FIG. 5A is a top view of the erector device in case that an excavation passage is straight.
Figure 5B:
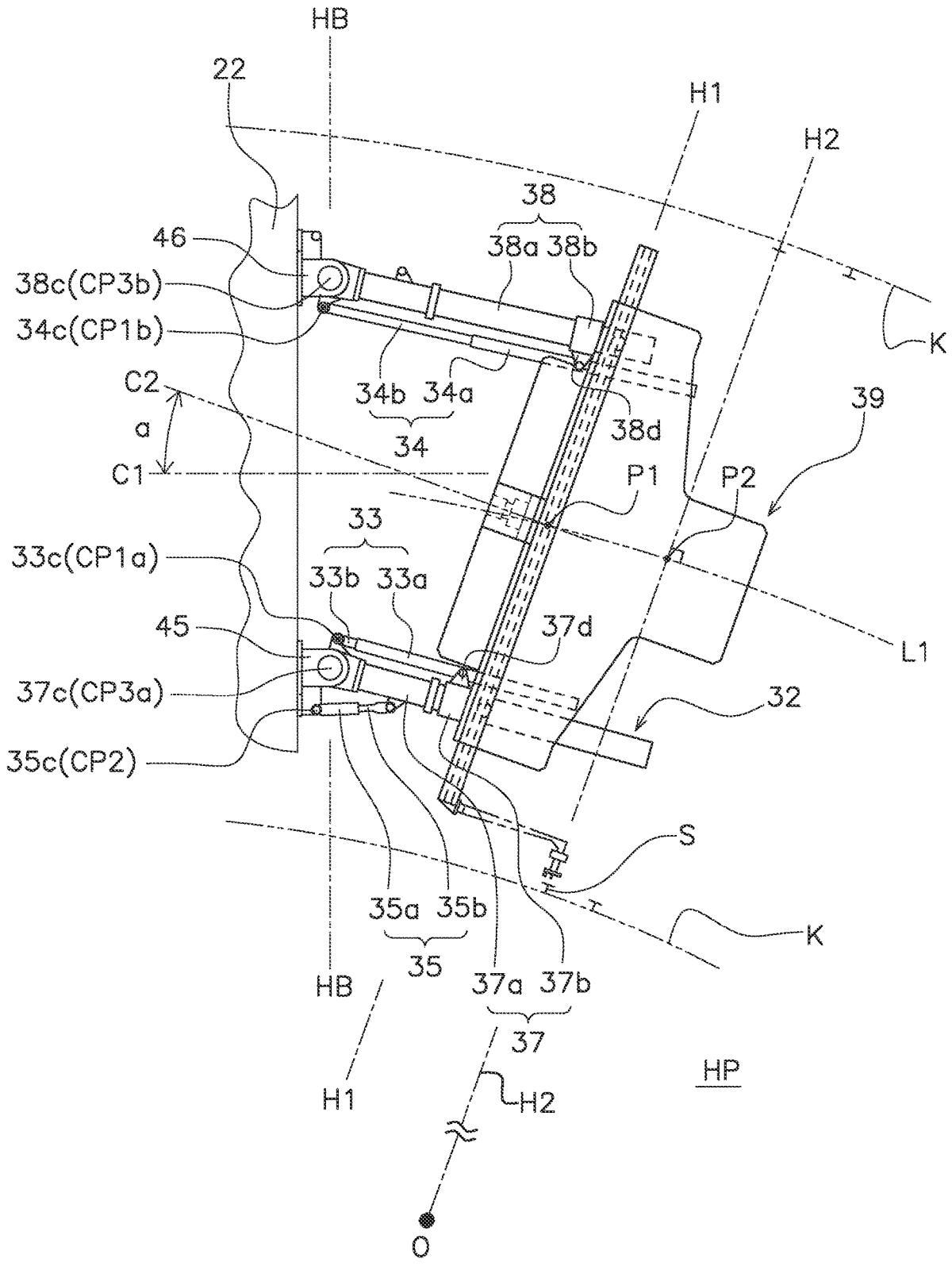
FIG. 5B is a top view of the erector device in case that the excavation passage is curved.

FIGS. 5A and 5B are top views of the erector device 30. The paper surface of FIGS. 5A and 5B shows a horizontal plane HP. As shown in FIGS. 5A and 5B, the posture changing device 32 is provided on the cutter-head support 22. The posture changing device 32 is configured to change an angle α formed by the turning axis C2 of the turning ring 31 and the rotation axis C1 of the cutter head 21 in a plan view (see FIG. 5B). Hereinafter, the angle α is described as a yaw angle α. The plan view is a word indicating a state where the tunnel excavation device 1 is viewed from the outside thereof in the direction in which gravity acts. For example, the term "plan view" may be interpreted as a word indicating a state where the tunnel excavation device 1 is viewed from the outside thereof in a direction in which support axes CP1*a* and CP1*b* extend. The support axes CP1*a* and CP1*b* will be described later.

The posture changing device 32 changes a posture of the turning ring 31 so that a center P2 of a shoring is disposed on a center axis L1 of the excavation passage K. A plurality of supporting members S are disposed in an annular shape along the wall surface of the excavation passage K of the tunnel. The shoring is formed in an annular shape by connecting the plurality of supporting members S.

For example, the posture changing device 32 changes the posture of the turning ring 31 so that a plane H2 (an example of a plane), which passes through the shoring formed in the annular shape by the plurality of supporting members S, is orthogonal to the center axis L1 of the excavation passage K. In case that the center axis L1 of the excavation passage K includes a curvature, for example, in a case of FIG. 5B, the posture changing device 32 changes the posture of the turning ring 31 so that the plane H2 passes through the center O of curvature. The plane H2 is defined by the annular shoring (the plurality of supporting members S). For example, the plane H2 is a plane including the center P2 of the annular shoring (the plurality of supporting members S).

The posture changing device 32 may change the posture of the turning ring 31 so that the center P1 of the turning ring 31 is disposed on the center axis L1 of the excavation passage K. In this case, a ring plane H1 is defined by the turning ring 31. The ring plane H1 is orthogonal to the turning axis C2 of the turning ring 31 and passes through the turning ring 31. The ring plane H1 is a parallel plane adjacent to the plane H2. The posture changing device 32 changes the posture of the turning ring 31 so that the ring plane H1 is orthogonal to the center axis L1 of the excavation passage K.

The ring plane H1 preferably passes through the center P1 of the turning ring 31 in a width direction of the turning ring 31. For example, when a width of the turning ring 31 varies in a circumferential direction, the ring plane H1 preferably pass through the center P1 of the turning ring 31 in the width direction at the widest portion of the turning ring 31 or the smallest width portion of the turning ring 31.

The posture changing device 32 changes the posture of the turning ring 31 between a first posture and a second posture. As shown in FIG. 5A, the center P1 of the turning ring 31 is disposed on the rotation axis C1 of the cutter head 21 in the first posture. The turning axis C2 and the rotation axis C1 of the cutter head 21 are disposed coaxially in the first posture. The yaw angle α is substantially zero in the first posture. As shown in FIG. 5B, the center P1 of the turning ring 31 is disposed away from the rotation axis C1 of the cutter head 21 in the second posture. The yaw angle α is a predetermined value such as a real number other than zero in the second posture.

As shown in FIGS. 5A and 5B, the posture changing device 32 includes the pair of thrust cylinders 33 and 34 and the yawing cylinder 35. The posture changing device 32 further includes the turning motor 36. The posture changing device 32 further includes a pair of guides 37 and 38 and the support frame 39.

The pair of thrust cylinders 33 and 34 adjust an interval and the yaw angle α between the cutter-head support 22 and turning ring 31. The pair of thrust cylinders 33 and 34 are disposed independently and telescopically between the cutter-head support 22 and the turning ring 31.

The pair of thrust cylinders 33 and 34 are disposed at the rear portion of the cutter-head support 22. For example, the pair of thrust cylinders 33 and 34 are respectively disposed at the rear portion of the cutter-head support 22 so that the support axes CP1*a* and CP1*b* of the thrust cylinders 33 and 34 are parallel to each other. The pair of thrust cylinders 33 and 34 is respectively mounted to the pair of guides 37 and 38 and the support frame 39 so that each of the pair of guides 37 and 38 can extend and contract.

Each of the pair of thrust cylinders 33 and 34 is mounted to a side surface of each of the pair of guides 37 and 38 (guide bars 37*a* and 38*a* which will be described later). Each of the pair of thrust cylinders 33 and 34 is mounted to the support frame 39 via each of the pair of the guides 37 and 38 (bar support portions 37*b* and 38*b* which will be described later).

Figure 6:
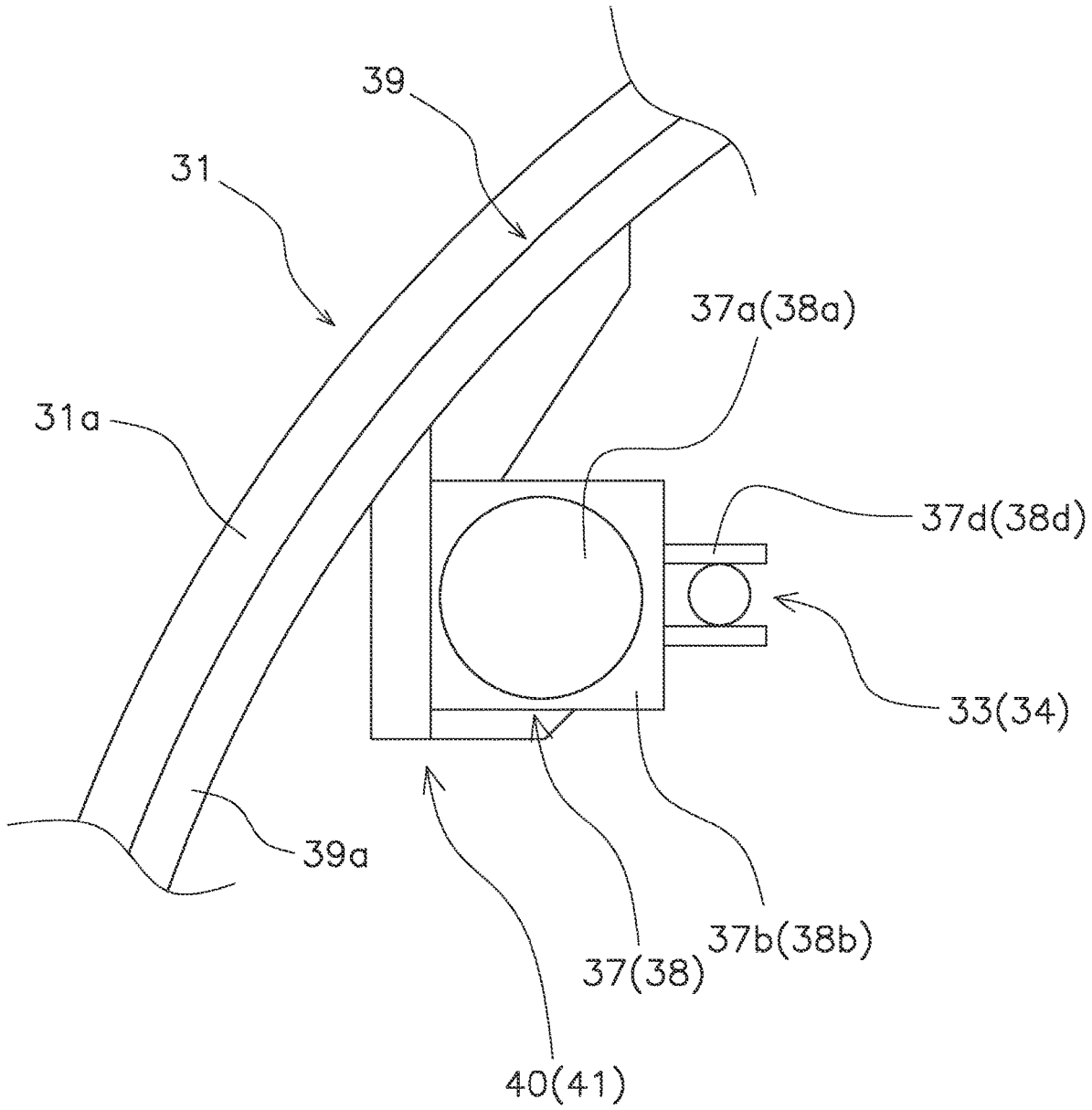
FIG. 6 is a partially enlarged front view of a mounted portion of the erector device.

For example, each of the pair of thrust cylinders 33 and 34 is mounted to each of the bar support portions 37*b* and 38*b* of the pair of guides 37 and 38. As shown in FIG. 6, each of the bar support portions 37*b* and 38*b* of the pair of guides 37 and 38 is mounted to the support frame 39. For example, each of the bar support portions 37*b* and 38*b* of the pair of guides 37 and 38 is mounted to the support frame 39 via each of a pair of mounted portions 40 and 41. The support frame 39 rotatably supports the turning ring 31 via a plurality of rollers 43 (see FIG. 4). In other words, each of the pair of thrust cylinders 33 and 34 is connected to the turning ring 31 via the support frame 39.

Specifically, each of the pair of thrust cylinders 33 and 34 includes a cylinder 33*a*, 34*a* and a rod 33*b*, 34*b* connected to a piston disposed in the cylinder 33*a*, 34*a*. Longitudinal intermediate portions of the cylinders 33*a* and 34*a* are respectively mounted to mounting portions 37*d* and 38*d* of bar support portions 37*b* and 38*b* of the guides 37 and 38. For example, the longitudinal intermediate portions of the cylinders 33*a* and 34*a* are respectively mounted to mounting portions 37*d* and 38*d* in a trunnion fashion. The bar support portions 37*b* and 38*b* of the guides 37 and 38 are mounted to the support frame 39 (a second annular portion 39*a* which will be described later).

Ends of rods 33*b* and 34*b* are respectively mounted to the guides 37 and 38, respectively. For example, the ends of rods 33*b* and 34*b* are respectively mounted to the guides 37 and 38 via support shafts 33*c* and 34*c*. The support shafts 33*c* and 34*c* include support axes CP1*a* and CP1*b*.

In this state, each of the pair of thrust cylinders 33 and 34 is disposed along each of the guides 37 and 38. For example, each of the pair of thrust cylinders 33 and 34 is disposed along each of the guides 37 and 38 so that a direction of extension and contraction of each of the thrust cylinders 33 and 34 is parallel to an axial direction in which each of the guides 37 and 38 extends.

The yawing cylinder 35 adjusts swing directions of the guides 37 and 38 and sliding directions of the thrust cylinders 33 and 34. The yawing cylinder 35 is disposed telescopically between the cutter-head support 22 and the guide 37.

The yawing cylinder 35 is provided at the rear portion of the cutter-head support 22. For example, the yawing cylinder 35 is swingably mounted to the rear portion of the cutter-head support 22 so that a direction of extension and contraction of the yawing cylinder 35 is different from the direction of extension and contraction of each of the thrust cylinders 33 and 34. The yawing cylinder 35 is swingably provided at the rear portion of the cutter-head support 22 so that a swing axis CP2 of the yawing cylinder 35 is parallel to the support axes CP1*a* and CP1*b* of the thrust cylinders 33 and 34.

For example, one end of the yawing cylinder 35 is swingably mounted to the rear portion of the cutter-head support 22. Specifically, one end of the yawing cylinder 35 is swingably mounted to the rear portion of the cutter-head support 22 via a mounting member 45.

The other end of the yawing cylinder 35 is connected to the guide 37. Specifically, the other end of the yawing cylinder 35 is connected to a side surface of the guide bar 37*a* (described later) of the guide 37. The other end of yawing cylinder 35 is connected to thrust cylinder 33 via the guide 37. The sliding direction of the thrust cylinder 33 is adjusted in the horizontal plane HP of the guides 37 and 38 by extension and contraction of the yawing cylinder 35.

The yawing cylinder 35 includes a cylinder 35*a* and a rod 35*b* connected to a piston disposed in the cylinder 35*a*. An end portion of the cylinder 35*a* is swingably mounted to the mounting member 45. For example, the end of the cylinder 35*a* is mounted to the mounting member 45 via a swing shaft 35*c*. The swing shaft 35*c* includes the swing axis CP2. The end of the rod 35*b* is swingably mounted to the guide 37.

The turning motor 36 is mounted to the support frame 39. The turning motor 36 is disposed adjacent to the turning ring 31 in the direction in which the turning axis C2 of the turning ring 31 extends. A rotating shaft of the turning motor 36 contacts an inner peripheral surface of the turning ring 31. The turning ring 31 rotates as the rotating shaft of the turning motor 36 rotates. For example, the turning ring 31 rotates with respect to the support frame 39 via a plurality of rollers 43 (see FIG. 4) by rotation of the rotating shaft of the turning motor 36.

The pair of guides 37 and 38 guide the turning ring 31 in the direction which the turning ring 31 moves away from the cutter-head support 22 and the direction in which the turning ring 31 moves closer to the cutter-head support 22.

As shown in FIGS. 4, 5A and 5B, the pair of guides 37 and 38 connect the cutter-head support 22 and the turning ring 31. For example, the pair of guides 37 and 38 connect cutter-head support 22 and turning ring 31 via the support frame 39.

As shown in FIG. 4, the pair of guides 37 and 38 support the turning ring 31. The pair of guides 37 and 38 support the turning ring 31 via the support frame 39. The support frame 39 is formed in a substantially annular shape. The support frame 39 is disposed on the inner peripheral side of the turning ring 31 so as to be coaxial with the turning axis C2 of the turning ring 31. The support frame 39 is fixed to the front body portion 11.

For example, the pair of guides 37 and 38 are supported by the support frame 39. The support frame 39 supports the turning ring 31. Specifically, the support frame 39 supports the turning ring 31 via the plurality of rollers 43.

As shown in FIGS. 5A and 5B, the pair of guides 37 and 38 are mounted to the cutter-head support 22. For example, the end of each of the pair of guides 37 and 38 is swingably mounted to the rear portion of the cutter-head support 22.

Each of the pair of guides 37 and 38 is swingably mounted to the rear portion of the cutter-head support 22 so that swing axes CP3*a* and CP3*b* of the guides 37 and 38 are parallel to each other. The pair of guides 37 and 38 are swingably provided to the rear of the cutter-head support 22 so that the swing axes CP3*a* and CP3*b* of the guides 37 and 38 are parallel to the support axes CP1*a* and CP1*b* of the thrust cylinders 33 and 34.

The pair of guides 37 and 38 are mounted to a support frame 39. For example, a support frame 39 is movably mounted to each of the pair of guides 37 and 38. An installation that the support frame 39 is mounted to the guides 37 and 38 will be described later.

Each of the pair of guides 37 and 38 extends and contracts in conjunction with the expansion and the contraction of each of the thrust cylinders 33 and 34. Each of the pair of guides 37 and 38 includes the guide bar 37*a*, 38*a* and the bar support portion 37*b*, 38*b*.

Each of the guide bars 37*a* and 38*a* is formed in a cylindrical shape. One end of each of the guide bars 37*a* and 38*a* is swingably mounted to the rear portion of the cutter-head support 22. For example, one end of each of the guide bars 37*a* and 38*a* is swingably mounted to the rear portion of the cutter-head support 22 via each of mounting members 45 and 46.

One end of each of the guide bars 37*a* and 38*a* is swingably mounted to each of the mounting members 45 and 46. For example, one end of each of the guide bars 37*a*, 38*a* is mounted to each of the mounting members 45 and 46 via each of pivot shafts 37*c* and, 38*c*. Each of the swing shaft portions 37*c* and 38*c* includes the swing axes CP3*a* and CP3*b*.

The other end of each of the guide bars 37*a* and 38*a* is slidably supported by each of the bar support portions 37*b* and 38*b*. The other end of each of the guide bars 37*a* and 38*a* is mounted to the support frame 39 via each of the bar support portions 37*b* and 38*b*.

Each of the bar support portions 37*b* and 38*b* is formed in a tubular shape. Each of the bar support portions 37*b* and 38*b* slidably supports each of the guide bars 37*a* and 38*a*. For example, the other end of each of the guide bars 37*a* and 38*a* is inserted into the inner portion of each of the bar support portions 37*b* and 38*b*. Each of the bar support portions 37*b* and 38*b* is mounted to a support frame 39. Each of the guide bars 37*a* and 38*a* is connected to the turning ring 31 by mounting each of the bar support portions 37*b* and 38*b* to the support frame 39.

As shown in FIGS. 3 and 4, the support frame 39 is disposed on a radially inner side of the turning ring 31. For example, the support frame 39 is disposed between the guides 37 and 38 and the turning ring 31. The support frame 39 rotatably supports the turning ring 31. The support frame 39 is movably supported along the pair of guides 37 and 38. The support frame 39 moves along the pair of guides 37 and 38.

The support frame 39 includes the second annular portion 39*a*. The support frame 39 further includes the pair of mounted portions 40 and 41 and a roof portion 39*b*. The second annular portion 39*a* is formed in a substantially annular shape. The second annular portion 39*a* is disposed so as to face an inner surface of the turning ring 31. For example, the second annular portion 39*a* is disposed at a predetermined interval from the inner surface of the turning ring 31. The second annular portion 39*a* rotatably supports the plurality of rollers 43, and the plurality of rollers 43 contact the inner peripheral surface of the turning ring 31.

The pair of guides 37 and 38 are respectively mounted to the pair of mounted portion 40 and 41. The pair of mounted portions 40 and 41 are provided on the second annular portion 39*a*. For example, the pair of mounted portions 40 and 41 are provided on the inner peripheral surface of the second annular portion 39*a*. The mounted portion 40 is formed integrally with the inner peripheral surface of the second annular portion 39*a*.

FIG. 6 is a partially enlarged view of the mounted portion 40. Since configuration of the mounted portion 41 is the same as the configuration of the mounted portion 40, reference numerals of the mounted portion 41 are given in parentheses in FIG. 6. As shown in FIG. 6, the bar support portions 37*b* and 38*b* of the guides 37 and 38 are respectively mounted to the mounted portions 40 and 41.

(Operation of the Tunnel Excavation Device)

In the tunnel excavation device 1 of the present embodiment, first, the bottom gripper 72, the upper gripper 73, and the pair of side grippers 74 press against the inner wall of the tunnel by protruding the bottom gripper 72, the upper gripper 73, and the pair of side grippers 74 from the gripper carrier 70. Thereby, the rear body portion 12 is supported by the inner wall of the tunnel.

In this state, the front body portion 11 moves forward with respect to the rear body portion 12 by extending the thrust cylinders 13*a*. Thereby, the cutter head 21 contacts the bedrock and the bedrock is excavated by the cutter head 21.

At this time, excavation of the bedrock is stably performed by sliding the vertical support 23, the pair of side supports 24, and the roof support 26 on the inner wall of the tunnel.

Next, the rear body portion 12 moves forward by contracting the thrust cylinder 13*a* in a state where the main beam 14 is supported upward by the rear support 18. The tunnel excavation device 1 moves forward while excavating by repeating such operations.

A pair of hydraulic cylinders (not shown) for moving backward can be mounted to a front portion of the bottom gripper 72.

The pair of hydraulic cylinders for moving backward are disposed between the bottom gripper 72 and a pair of rails and connect the bottom gripper 72 and the pair of rails. The tunnel excavation device 1 can move backward by extending and retracting the pair of hydraulic cylinders.

(Operation of the Erector Device)

After the tunnel excavation device 1 excavates, the shoring is installed on the wall surface of the tunnel and supports the wall surface of the tunnel. The erector device 30 operates to dispose the supporting members S, which configures the shoring, near the wall surface. In this embodiment, an example, in which one shoring is configured by the plurality of supporting members S, is shown. The one shoring may be configured by one tunnel supporting member S. For example, as shown in FIG. 5A, in case that the tunnel excavation device 1 forms a straight excavation passage K, the yawing cylinder 35 supports the guide 37 so that the guide 37 is disposed along the rotation axis C1 of the cutter head 21. In this case, the guide 38 is disposed along the rotation axis C1 of the cutter head 21 via the support frame 39.

In this case, the turning ring 31 (the support frame 39) moves away from the cutter-head support 22 along the pair of guides 37 and 38 by extending the pair of thrust cylinders 33 and 34 by the same amount. Thereby, the turning ring 31 is disposed at a predetermined position.

Also, in a state where the turning ring 31 and the support frame 39 are away from the cutter-head support 22, the turning ring 31 (the support frame 39) moves closer to the cutter-head support 22 by contracting the pair of thrust cylinders 33 and 34 by the same amount. Thereby, the turning ring 31 is disposed at a predetermined position.

In the state where the turning ring 31 is disposed as shown in FIG. 5A, the center P1 of the turning ring 31 is disposed on the rotation axis C1 of the cutter head 21. This posture of the turning ring 31 is the first posture. In the first posture, the ring plane H1 is parallel to a reference plane HB including the pair of swing axes CP3*a* and CP3*b*. In the first posture, the yaw angle $\alpha$ is substantially zero.

On the other hand, as shown in FIG. 5B, in case that the tunnel excavation device 1 forms a curved excavation passage K, the yawing cylinder 35 supports the guide 37 so that the guide 37 inclines with respect to the reference plane HB. In this case, the guide 38 is disposed so as to inclines with respect to the reference plane HB via the support frame 39.

In this case, the turning ring 31 is disposed in a predetermined position so that the ring plane H1 inclines with respect to the reference plane HB by extending the thrust cylinder 34 and contracting the thrust cylinder 33, In case that the turning ring 31 is disposed at a predetermined position as shown in FIG. 5B, the center P1 of the turning ring 31 is disposed away from the rotation axis C1 of the cutter head 21. This posture of the turning ring 31 is the second posture. In the second posture, the ring plane H1 inclines with respect to the reference plane HB. In the second posture, the yaw angle $\alpha$ is a predetermined value, such as a real number other than zero.

The turning ring 31 is disposed so that the plane H2, which is defined by the shoring (the plurality of supporting members S), is orthogonal to the center axis L1 of the excavation passage K by operating the pair of thrust cylinders 33 and 34 and the yawing cylinder 35 as described above when the excavation passage K is straight and when the excavation passage K is curved. The yawing cylinder 35 extends and contracts in conjunction with extension and contraction of the thrust cylinders 33 and 34. The plane H2 may be defined by a plane that includes a locus formed by the other end of the support holding portion 31*b* during turn of the turning ring 31.

In a state where the turning ring 31 is disposed in the predetermined position as described above, the supporting members S are disposed on the excavation passage K of the tunnel. In the following, the process for disposing the supporting members S in the excavation passage K will be briefly described with an example, in which the excavation passage K is formed in the curved shape as shown in FIG. 5B.

First, the supporting member S, for example, arc-shaped H-section steel is disposed on the support holding portion 31*b* of the turning ring 31. Next, the supporting member S is disposed on a predetermined position facing the excavated wall surface by rotating the turning ring 31. The plurality of supporting members S are annularly arranged by repeating this process. Finally, the plurality of supporting members S are connected to each other in a state where the plurality of supporting members S pressed against the excavated wall surface. Thereby, the excavated wall surface can be supported by the shoring which is configured by connecting the plurality of supporting members S.

The tunnel excavation device 1 of the above configuration includes the front body portion 11 and the erector device 30. The front body portion 11 includes the cutter head 21 and the cutter-head support 22 which rotatably supports the cutter head 21. The erector device 30 is provided on the cutter-head support 22. The erector device 30 includes the turning ring 31 holding the supporting members S and the posture changing device 32. The posture changing device 32 is configured to change the yaw angle $\alpha$ formed by the turning axis C2 of the turning ring 31 and the rotation axis C1 of the cutter head 21 in the plan view.

In this configuration, the supporting members S can be suitably disposed on the excavation passage K of the tunnel which is formed in the curved shape, since the posture changing device 32 changes the yaw angle α.

In the tunnel excavation device 1, in case that the center axis L1 of the excavation passage K includes the curvature, the posture changing device 32 changes the posture of the turning ring 31 so that the plane H2, which passes through the shoring annularly formed along the wall surface of the excavation passage K of the tunnel by the plurality of supporting members S, is orthogonal to the center axis L1 of the excavation passage K. The plane H2 preferably passes through the center P2 of the shoring (the supporting members S) in the width direction of the shoring (the supporting members S). The term "including curvature" means that the curvature is not zero.

In this configuration, the shoring (the plurality of supporting members S) can be suitably disposed on the wall surface of the excavation passage K of the tunnel in which the excavation passage K is formed in the curved shape. In addition, the shoring (the plurality of supporting members S) can suitably receive load which acts received from the tunnel wall surface to the shoring.

In the tunnel excavation device 1, the posture changing device 32 changes the posture of the turning ring 31 between the first posture and the second posture. The first posture is a posture in which the center P1 of the turning ring 31 is disposed on the rotation axis C1 of the cutter head 21. The second posture is a posture in which the center P1 of the turning ring 31 is disposed at a position away from the rotation axis C1 of the cutter head 21.

In this configuration, the supporting members S can be suitably disposed on the excavation passage K which is formed in the curved shape, since the posture changing device 32 changes the posture of the turning ring 31 between the first posture and the second posture.

The tunnel excavation device 1 further includes the rear body portion 12 which is disposed behind the cutter-head support 22. The erector device 30 is disposed between the cutter-head support 22 and the rear body portion 12.

In this configuration, the supporting members S can be suitably disposed on the excavation passage K which is formed in the curved shape, since the erector device 30 is disposed behind the cutter-head support 22.

In the tunnel excavation device 1, the posture changing device 32 includes the pair of thrust cylinders 33 and 34. The pair of thrust cylinders 33 and 34 are disposed so as to be independently extendable and contractable between the cutter-head support 22 and the turning ring 31 to adjust an interval between the cutter-head support 22 and the turning ring 31. The pair of thrust cylinders 33 and 34 are swingably provided on the cutter-head support 22 so that the support axes CP1*a* and CP1*b* of the pair of thrust cylinders 33 and 34 are parallel to each other.

In this configuration, the posture of the turning ring 31 is changed by using the pair of thrust cylinders 33 and 34. Even if the tunnel excavation device 1 includes this configuration, the supporting members S can be suitably disposed on the excavation passage K which is formed in the curved shape.

In the tunnel excavation device 1, the posture changing device 32 further includes the yawing cylinder 35. The yawing cylinder 35 is disposed so as to be extendable and contractable between the cutter-head support 22 and the guides 37 and 38 to adjust the swing direction of the guides 37 and 38. The yawing cylinder 35 is swingably mounted on the cutter-head support 22 so that the direction of extension and contraction of the yawing cylinder 35 is different from the direction of extension and contraction of the thrust cylinders 33 and 34.

In this configuration, the sliding directions of the thrust cylinders 33 and 34 by the yawing cylinder 35. In this state, the posture of the turning ring 31 is further changed by the thrust cylinders 33 and 34. Even if the tunnel excavation device 1 includes this configuration, the supporting members S can be suitably disposed on the excavation passage K which is formed in the curved shape.

In the tunnel excavation device 1, the yawing cylinder 35 is swingably provided on the cutter-head support 22 so that the swing axis CP2 of the yawing cylinder 35 is parallel to the support axes CP1*a* and CP1*b* of the thrust cylinders 33 and 34.

The supporting members S can be suitably disposed on the excavation passage K which is formed in the curved shape by configuring the yawing cylinder 35 in this manner.

In the tunnel excavation device 1, the posture changing device 32 further includes guides 37 and 38. The guides 37 and 38 are swingably provided on the cutter-head support 22 to guide the turning ring 31 in the direction in which the turning ring 31 moves away from the cutter-head support 22 and the direction in which the turning ring 31 moves closer to the cutter-head support 22.

In this configuration, the supporting members S can be suitably disposed on the excavation passage K which is formed in the curved shape, since the guides 37 and 38 guide the turning ring 31.

In the tunnel excavation device 1, the posture changing device 32 further includes a support frame 39 which is disposed on a radially inner side than the turning ring 31. The support frame 39 rotatably supports the turning ring 31 and is movably supported by the guides 37 and 38.

In this configuration, the support frame 39, which rotatably supports the turning ring 31, is supported by the guides 37 and 38. Even if the tunnel excavation device 1 includes this configuration, the supporting members S can be suitably disposed on the excavation passage K which is formed in the curved shape.

Modification (A1) In the above embodiment, an example in which one yawing cylinder 35 is used was shown, but a pair of yawing cylinders 35 may be used. In this case, for example, the pair of yawing cylinders 35 are respectively mounted to the pair of mounting members 45 and 46 and the pair of guides 37 and 38.

In the present disclosure, a supporting member can be suitably disposed on an excavation passage in case that a tunnel excavation device forms a curved excavation passage.

What is claimed is:

1. A tunnel excavation device comprising:

a first body portion including a cutter head and a support portion rotatably supporting the cutter head;

a second body portion disposed behind the support portion;

a connecting portion connecting the first body portion and the second body portion; and an erector device configured to transport a supporting member toward an excavated wall surface, provided on the support portion, and including a ring portion holding the supporting member and a posture changing device configured to change an angle formed by a center axis of the ring portion and a rotation axis of the cutter head in a plan view, the erector device being disposed between the support portion of the first body portion and the second body portion.

2. The tunnel excavation device according to claim 1, wherein the posture changing device is configured to change a posture of the ring portion so that a plane, which passes through a shoring formed in an annular shape by the supporting member, is orthogonal to a central axis of an excavation passage in a case that the central axis of the excavation passage includes a curvature.

3. The tunnel excavation device according to claim 1, wherein the posture changing device is configured to change the posture of the ring portion between a first posture in which a center of the ring portion is disposed on the rotation axis of the cutter head and a second posture in which the center of the ring portion is disposed at a position away from the rotation axis of the cutter head.

4. The tunnel excavation device according to claim 1, wherein the posture changing device includes a pair of first cylinders disposed so as to be independently extendable and contractable between the support portion and the ring portion to adjust an interval between the support portion and the ring portion.

5. The tunnel excavation device according to claim 4, wherein the pair of first cylinders are configured to swing with respect to the support portion, and the posture changing device further includes a second cylinder configured to adjust a sliding direction of the first cylinder.

6. The tunnel excavation device according to claim 5, wherein the posture changing device further includes a pair of guides swingably provided on the support portion to guide the ring portion in a direction in which the ring portion moves away from the support portion and a direction in which the ring portion moves closer to the support portion, and the pair of first cylinders are respectively mounted to the pair of guides.

7. The tunnel excavation device according to claim 6, wherein the posture changing device further includes a support frame disposed on a radially inner side than the ring portion, and the support frame rotatably supports the ring portion and is supported by the guides.

8. A tunnel excavation device comprising:

a first body portion including a cutter head and a support portion rotatably supporting the cutter head;

an erector device configured to transport a supporting member toward an excavated wall surface, provided on the support portion, and including a ring portion holding the supporting member and a posture changing device configured to change an angle formed by a center axis of the ring portion and a rotation axis of the cutter head in a plan view, the posture changing device including a pair of first cylinders disposed so as to be independently extendable and contractable between the support portion and the ring portion to adjust an interval between the support portion and the ring portion, the pair of first cylinders being configured to swing with respect to the support portion, a second cylinder configured to adjust a sliding direction of the pair of first cylinders, and a pair of guides swingably provided on the support portion to guide the ring portion in a direction in which the ring portion moves away from the support portion and a direction in which the ring portion moves closer to the support portion, the pair of first cylinders being respectively mounted to the pair of guides.

9. The tunnel excavation device according to claim 8, wherein the posture changing device further includes a support frame disposed on a radially inner side than the ring portion, and the support frame rotatably supports the ring portion and is supported by the guides.

* * * * *